US006784618B2

(12) United States Patent
Moi et al.

(10) Patent No.: US 6,784,618 B2
(45) Date of Patent: Aug. 31, 2004

(54) GLASS PLATE PROVIDED WITH ELECTRODES MADE OF A CONDUCTING MATERIAL

(75) Inventors: Agide Moi, Seyssins (FR); Luc Berthier, Grenoble (FR); Jean-Pierre Creusot, Eybens (FR)

(73) Assignee: Syngenta Participations AG, Basel (CH)

( * ) Notice: Subject to any disclaimer, the term of this patent is extended or adjusted under 35 U.S.C. 154(b) by 0 days.

(21) Appl. No.: 10/333,515

(22) PCT Filed: Jun. 13, 2001

(86) PCT No.: PCT/FR01/01822

§ 371 (c)(1),
(2), (4) Date: Apr. 14, 2003

(65) Prior Publication Data

US 2003/0151365 A1 Aug. 14, 2003

(51) Int. Cl.[7] ..... H01J 17/04
(52) U.S. Cl. ..... 313/633; 313/631; 313/582
(58) Field of Search ..... 313/584–587, 313/631, 633, 311; 315/169.4; 445/46

(56) References Cited

U.S. PATENT DOCUMENTS 5,793,158 A 8/1998 Wedding, Sr. ..... 313/493
5,993,543 A * 11/1999 Aoki et al. ..... 117/88
6,465,956 B1 * 10/2002 Koshio et al. ..... 313/586
6,503,858 B1 * 1/2003 Yamamoto et al. ..... 501/32

FOREIGN PATENT DOCUMENTS

| | | | |
|---|---|---|---|
| JP | 56 121254 | 9/1981 | ..... H01J/17/04 |
| JP | 06 139923 | 5/1994 | ..... H01J/9/02 |
| JP | 09 245652 | 9/1997 | ..... H01J/11/02 |
| JP | 11 242935 | 9/1999 | ..... G09F/9/35 |

* cited by examiner

*Primary Examiner*—Vip Patel
*Assistant Examiner*—Glenn Zimmerman
(74) *Attorney, Agent, or Firm*—Syngenta Biotechnology, Inc.

(57) ABSTRACT

The invention concerns faceplate, more particularly for plasma display, comprising a substrate on which is provided at least one electrode, made of conductive material consisting of a metal alloy based on aluminium and/or zinc having a melting point higher than 700° C.; the electrode is designed to be coated with a dielectric layer. Thus, the harmful effects derived from reactions of the electrode materials with those of the dielectric layer are limited, in particular when said layer is being cured.

10 Claims, 2 Drawing Sheets

GLASS PLATE PROVIDED WITH ELECTRODES MADE OF A CONDUCTING MATERIAL

This application claims the benefit under 35 U.S.C. §365 of International Application PCT/FR01/01822, filed Jun. 13, 2001, which claims the benefit of French Application No. 0009570, Jul. 21, 2000.

BACKGROUND OF THE INVENTION

The present invention relates to a plate comprising a glass substrate on which at least one electrode made of a conducting material is produced. It relates more particularly to the material for producing the electrodes, especially when the plate is used in the manufacture of display panels, such as plasma display panels.

To simplify the description and to make the problem posed more easily understood, the present invention will be described with reference to the manufacture of plasma display panels. However, it is obvious to a person skilled in the art that the present invention is not limited to the process for manufacturing plasma display panels, but can be used in all types of processes requiring materials of the same type under similar conditions.

DESCRIPTION OF PRIOR ART

As is known from the prior art, plasma display panels (PDPs) are display screens of the flat screen type. There are several types of PDP, all operating on the same principle of an electrical discharge in a gas accompanied by the emission of light. In general, PDPs consist of two insulating plates made of glass, conventionally glass of the soda-lime type, each supporting at least one array of conducting electrodes and defining between them a gas space. The plates are joined together so that the arrays of electrodes are orthogonal, each electrode intersection defining an elementary light cell to which a gas space corresponds.

The electrodes of a plasma display panel must exhibit a certain number of characteristics. Thus, they must have a low electrical resistivity. This is because, since the electrodes supply thousands of cells, a high current flows in the electrode, possibly going up to an instantaneous 500 mA to 1 A. Furthermore, since plasma display panels have a large size, possibly with a diagonal of up to 60 inches, the length of the electrodes is great. Under these conditions, too high a resistance may result in a significant loss of luminous efficiency due to the voltage drop associated with the flow of current through the electrodes.

Usually in plasma display panels the array of electrodes is covered with a thick layer of a dielectric, in general borosilicate glass. The electrodes must therefore have a high corrosion resistance, particularly during baking of the dielectric layer; this is because, during this phase of the process, the reactions between the dielectric layer and the electrode, or even between the glass of the plate and the electrode, cause an increase in the electrical resistance of the electrode and the products of these reactions result in a reduction in the optical transmission, in the dielectric constant and in the breakdown voltage of the dielectric layer.

At the present time, there are two techniques used for producing the electrodes of a plasma display panel. The first technique consists in depositing a paste or ink based on silver, gold or a similar material. This conductive paste is deposited, generally with a thickness greater than or equal to 5 $\mu$m, by various screen printing, vapour deposition and coating processes. In this case, the electrodes are obtained directly during deposition or by a photogravure process. This thick-film technology makes it possible to obtain low electrode resistances that are unaffected by the annealing of the dielectric layer, namely R=4 to 6 m$\Omega$ in the case of electrodes made of silver paste from 4 to 6 $\mu$m in thickness, deposited by screen printing. However, this technique requires a specific anneal at a temperature above 500° C. in order to obtain conduction and requires the use of several specific dielectric layers in order to minimize the diffusion of the electrode materials into the dielectric, such diffusion being likely to degrade the electrical and optical characteristics of the panel.

The second technique consists of thin-film deposition of metal. In this case, the thickness of the layers is from a few hundred ångströms to a few microns. The electrodes are generally obtained by photolithography or "lift-off" of a thin layer of copper or aluminium deposited by vacuum evaporation or by sputtering. This thin-film technology does not require annealing to obtain electrode conduction. It makes it possible to obtain an electrode resistance R=5 to 12 m$\Omega$ depending on the materials used for electrodes having a thickness of 2 to 5 $\mu$m. However, the materials used in this case, although having a high conductivity, react with the glass substrate and the dielectric layer during its baking, thereby resulting in an increase in the resistance of the electrodes and in the performance of the dielectric layer being impaired owing to the diffusion into the dielectric of the products arising from the reaction between the electrode material and the dielectric layer. The formation of strings of bubbles that reduce the transparency of the dielectric layer, its dielectric constant and its breakdown voltage is observed. To remedy this drawback, it has been proposed to deposit multilayers consisting, for example, of Al—Cr, Cr—Al—Cr or Cr—Cu—Cr multilayer stacks. These multilayers make it possible to limit the degradation of the dielectric layer and the increase in the electrode resistance during baking of the said dielectric layer. However, this technique has a number of drawbacks. It requires the implementation of a more complex chemical etching process, with the use of at least two different etching solutions. After the chemical etching, the width of each of the layers of the stack may then be different, giving very irregular electrode sidewalls, which encourages the bubbles to become trapped during baking of the dielectric layer.

SUMMARY OF THE INVENTION

The object of the present invention is therefore to remedy the abovementioned drawbacks of the thin-film deposition technique by providing a novel material for producing an array of electrodes on a glass substrate.

Thus, the subject of the present invention is a plate comprising a glass substrate on which at least one electrode of a conducting material is produced, characterized in that, at least at the interface between the said electrodes and the glass and/or at least at the interface between the said electrodes and the dielectric layer, the conducting material of the electrodes consists of an aluminium-based and/or zinc-based metal alloy having a melting point above 700° C.

Moreover, the aluminium-based and/or zinc-based metal alloy includes at least 0.01% by weight of at least one dopant whose nature and proportions in the alloy are tailored so that the said alloy has a melting point above 700° C.; preferably, the nature of the dopant is tailored so that the corresponding alloy does not have an eutectic; preferably, this dopant is chosen from the group comprising titanium, zirconium, vanadium, chromium, molybdenum, tungsten, manganese, iron (zinc-based alloy) and antimony. By using such an alloy to produce the electrodes it is possible to increase the temperature difference between the melting point of the material producing the array of electrodes and the temperature at which the dielectric layer deposited on the electrodes is based, this temperature generally being between 500° C. and 600° C.; consequently, especially during the step of baking the dielectric layer, the deleterious effects resulting from the reactions of the electrode material with the materials of the dielectric layer, or even with the glass of the substrate, are considerably reduced.

The dopant is preferably chosen so as to obtain an alloy having an electrical resistivity as close as possible to that of the pure conducting material.

DESCRIPTION OF THE DRAWING

Further features and advantages of the present invention will become apparent from the description given below of one embodiment of the present invention, this description referring to the appended drawing in which.

For the sake of clarity, the figures are not drawn to scale.

Figure 1A:
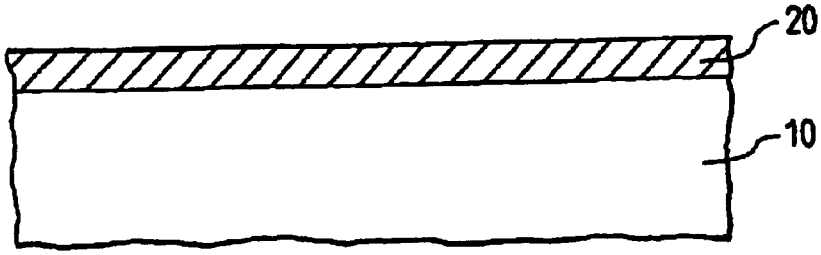
FIGS. 1*a* to 1*d* show, in cross section, the various steps for producing a plate for a plasma display panel.

As shown in FIG. 1*a*, the embodiment of the present invention is produced on a substrate 10 that may consist, for example, of a glass called float glass. Optionally, the glass substrate may be annealed or fashioned. between 0.01% and 49% by weight of at least one dopant; the nature and the proportions of the dopants are tailored, in a manner known per se, so that the alloy has a melting point above 700° C.; preferably, these dopants are chosen so as to form alloys with no eutectic; preferably, these dopants are chosen so as to have expansion coefficients very much less than that of the conducting material in order to reduce the expansion coefficient of the alloy and to make it close to that of the substrate and also that of the dielectric, as explained below; preferably, this dopant is chosen from the group comprising manganese, vanadium, titanium, zirconium, chromium, molybdenum, tungsten, iron (zinc-based alloy) and antimony; preferably, the dopant proportions are around 2% by weight in the alloy.

To deposit the layer 20 of conducting material, a conventional method of the prior art is used; preferably, a vacuum deposition method is used, such as vacuum sputtering, vacuum evaporation or chemical vapour deposition (CVD).

Figure 2A:
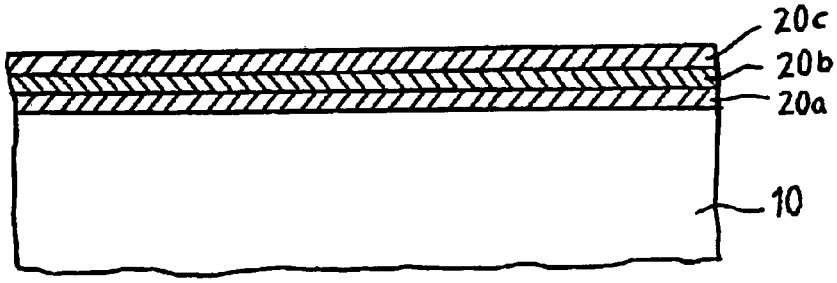
FIGS. 2*a* and 2*b* illustrate variant of the embodiment depicted in FIGS. 1*a* to 1*d*.
Figure 2B:
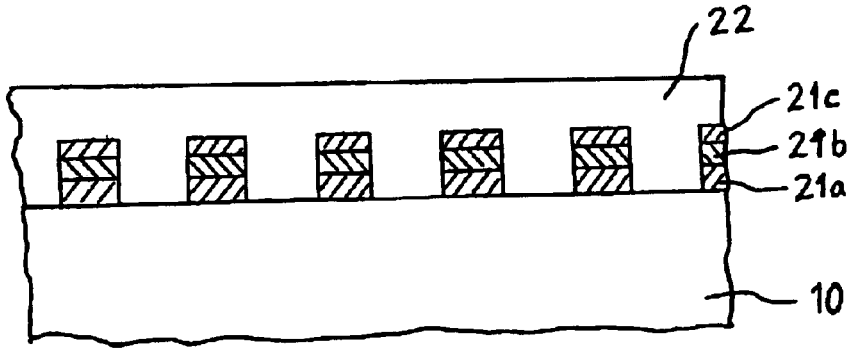

According to a variant of the present invention illustrated in FIG. 2*a*, the thin layer 20 may be a multilayer and may be deposited by vacuum deposition using, for example, several targets in the case of vacuum sputtering. According to this variant, a first alloy layer 20*a* for the part in contact with the substrate 10 will be deposited first of all, followed by a conducting layer 20*b* of the aluminium or zinc base material with no dopant, and then another alloy layer 20*c* intended to be in contact with the dielectric layer, the composition of the second alloy layer 20*b* possibly being different from that of the first alloy layer 20*a*.

Figure 1B:
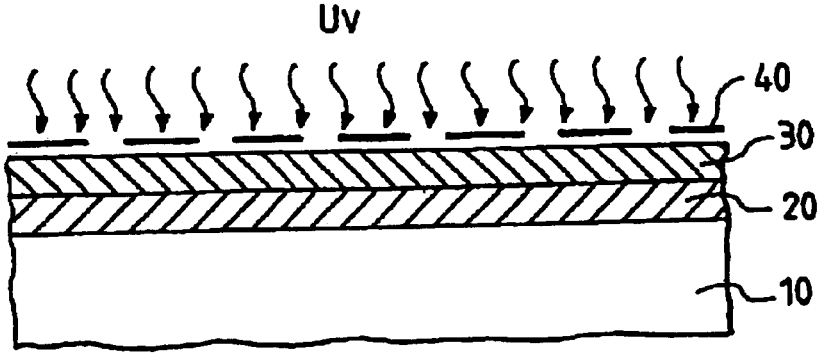
Figure 1C:
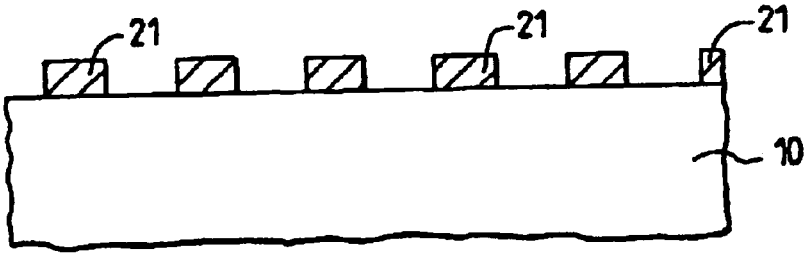

FIGS. 1*b* and 1*c* show schematically the production of the array of electrodes following the deposition of a metal layer 20 which, in the present case, is an aluminum-based alloy having a melting point above 700°C. The patterns of electrodes 21 are produced using known processes of the lift-off or photogravure type. As shown in FIG. 1*b*, the layer 20 is covered with a resist 30 and is then etched. The pattern of the electrodes 21 is defined by means of a mask 40 irradiated by UV, depending on the type of resist used, namely a positive or a negative resist. Next, the electrodes themselves are etched using a single etching solution having a composition identical or similar to that used for pure aluminum.

The method of manufacturing the array of electrodes that has just been described makes it possible to obtain identical widths for the various electrode layers; an electrode geometry comparable to that obtained by manufacturing electrodes made of pure aluminium is therefore obtained; more specifically, sidewalls are obtained that are much more regular than in the case of multilayers such as the above-mentioned known Al—Cr or Cr—Al—Cu or Cr—Cu multilayers; moreover, only a single etching solution is used, which is more economical.

Figure 1D:
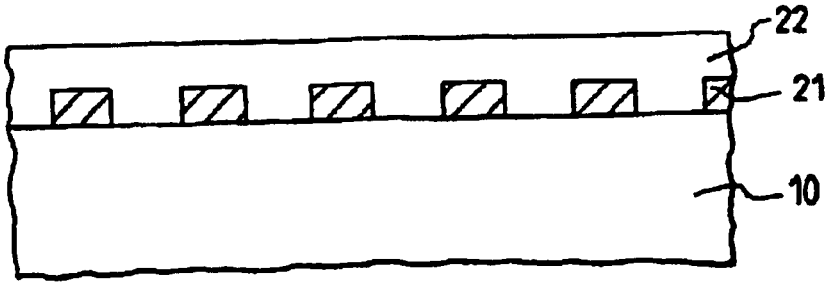

As shown in FIG. 1*d*, the electrodes 21 are then covered with a thick layer 22 of a dielectric using a conventional method such as the screen printing, roll coating or spraying of a suspension or of a dry powder. As is known, the dielectric layer consists of a glass or an enamel based on lead oxide, silicon oxide and boron oxide, based on bismuth oxide, silicon oxide and boron oxide, containing no lead, or based on bismuth oxide, lead oxide, silicon oxide and boron oxide in the form of a mixture. Once the dielectric layer has been deposited, the assembly is annealed, in a known manner, at a temperature between 500° C. and 600° C.

FIG. 2*a* is an illustration of the electrodes 21 fabricated from the conductor layer according to the variant of the present invention illustrated in FIG. 2*a*. In this embodiment of the present invention, the conductor layer consisted of multiple layers 20*a*, 20*b*, and 20*c*. After the electrode pattern is formed using the lift-off or photogravure type processes as discussed above, an array of electrodes having multiple conductor layers 21*a*, 21*b*, and 21*c* is formed. Similar to the embodiment of the present invention illustrated in FIG. 1*d*, the electrodes are covered with a thick layer 22 of dielectric.

The use as conducting layer of an aluminium-based metal alloy having a melting point above 700° and including as dopant an element chosen from titanium, zirconium, vanadium, chromium, molybdenum, tungsten, manganese and antimony has a number of advantages. Titanium, zirconium, vanadium, chromium, molybdenum, tungsten, manganese and antimony form alloys not having a eutectic. An aluminium alloy containing 2 wt % vanadium or titanium has a melting point of about 900° C., compared with 660° for pure aluminium. Moreover, the melting point of an aluminium alloy containing 2% manganese is 700° C. and has a resistivity of about 4 $\mu\Omega$.cm compared with 2.67 $\mu\Omega$.cm for pure aluminium. In addition, the above materials have expansion coefficients very much lower than that of aluminium, thereby making it possible to reduce the expansion coefficient of the alloy and bring it close to that of the substrate and of the dielectric layer. Thus, the risks of cracks appearing in the dielectric layer and in the magnesia layer during the various baking steps are therefore reduced.

Given below is an example allowing the advantages of the present invention to be understood. Electrodes made of an aluminium alloy containing 2% titanium with a thickness of 3 $\mu$m have an R of 25 m$\Omega$ after the dielectric layer has been baked at 585° C. for 1 hour, this value being close to that obtained before baking. In this case, the electrode/glass interface has a uniform metallic appearance and there is no string of bubbles at the electrode/dielectric layer interface. As a comparison, electrodes made of pure aluminium with a thickness of 3 $\mu$m have an R which goes from 10 m$\Omega$ before baking the dielectric layer to 25 $\mu\Omega$ after baking the dielectric layer at a temperature above 550° C. for 1 hour. In this case, the appearance of the metal/glass interface is greyish and non-uniform, and many strings of bubbles are present at the electrode/dielectric layer interface.

It is obvious to a person skilled in the art that the present invention can be applied to other types of aluminium alloys and to zinc alloys.

What is claimed is:

1. Plate comprising a glass substrate supporting an array of conducting electrodes covered with a dielectric layer, wherein, at least at the interface between said electrodes and the glass and/or at least at the interface between said electrodes and the dielectric layer, the conducting material of the electrodes consists of an aluminum-based and/or zinc-based metal alloy having a melting point above 700° C.

2. Plate according to claim 1, wherein the said alloy comprises, apart from said base metal, at least 0.01% by weight of at least one dopant whose nature and proportions in the alloy are tailored so that said alloy has a melting point above 700° C.

3. Plate according to claim 2, wherein the nature of at least one dopant is tailored so that the corresponding alloy does not have an eutectic.

4. Plate according to claim 2, wherein at least one dopant is chosen from the group comprising titanium, zirconium, vanadium, chromium, molybdenum, tungsten, manganese, iron and antimony.

5. Plate according to claim 4, wherein, when the base metal is aluminum, at least one dopant is chosen from the group comprising vanadium, titanium and manganese.

6. Plate according to claim 5, wherein the proportions by weight of the at least one dopant in said alloy are around 2%.

7. Plate according to claim 1, wherein the electrodes consist of at least one thin layer of said alloy.

8. Plate according to claim 7, wherein the electrodes consist of a stack of thin layers, comprising:

at least one thin layer consisting of said alloy in contact with the glass of the substrate and/or in contact with the dielectric layer; and a thin layer consisting of the said base metal.

9. Plate according to claim 1, wherein the dielectric layer consists of a glass or an enamel based on lead oxide, silicon oxide and boron oxide, based on bismuth oxide, silicon oxide and boron oxide, containing no lead, or based on bismuth oxide, lead oxide, silicon oxide and boron oxide in the form of a mixture.

10. Plate according to claim 1, wherein said plate is used in the manufacture of display panels comprising plasma display panels.

* * * * *

UNITED STATES PATENT AND TRADEMARK OFFICE

CERTIFICATE OF CORRECTION

PATENT NO. : 6,784,618 B2 
DATED : August 31, 2004
INVENTOR(S) : Agide Moi, Luc Berthier and Jean-Pierre Creusot It is certified that error appears in the above-identified patent and that said Letters Patent is hereby corrected as shown below:

Title page,
Item [73], Assignee, should read -- Thomson Plasma --

Signed and Sealed this

Seventh Day of June, 2005

JON W. DUDAS
*Director of the United States Patent and Trademark Office*